United States Patent [19]

Students

[11] Patent Number: 4,925,095

[45] Date of Patent: May 15, 1990

[54] MULTI-ORIFICE MANIFOLD FOR BALANCING DISCHARGE OF LIQUIFIED GASES

[75] Inventor: Peter A. Students, Westchester, Ill.

[73] Assignee: Liquid Air Corporation, Walnut Creek, Calif.

[21] Appl. No.: 193,087

[22] PCT Filed: Nov. 3, 1986

[86] PCT No.: PCT/US86/02368

§ 371 Date: Apr. 7, 1988

§ 102(e) Date: Apr. 7, 1988

[51] Int. Cl.[5] ..... B05B 1/14

[52] U.S. Cl. ..... 239/1; 239/565

[58] Field of Search ..... 239/159, 161, 163, 1, 239/266–269, 548, 550, 556, 565, 568

[56] References Cited

U.S. PATENT DOCUMENTS

| | | | |
|---|---|---|---|
| 260,761 | 7/1882 | Lynch . | |
| 1,107,119 | 8/1914 | Searle . | |
| 1,676,472 | 7/1928 | Axtell et al. | 239/550 X |
| 1,936,249 | 11/1933 | Leser | 239/268 X |
| 2,019,922 | 11/1935 | McLellon | 239/565 X |
| 2,152,407 | 3/1939 | Fawley | 239/550 X |
| 2,548,788 | 4/1951 | Helme | 239/550 X |
| 2,606,066 | 8/1952 | Thompson . | |
| 2,607,617 | 8/1952 | Pringle . | |
| 2,692,674 | 9/1937 | Kennedy | 239/565 X |
| 3,143,295 | 8/1964 | Booker | 239/142 |
| 3,310,011 | 3/1967 | Miller | 239/159 X |
| 3,311,305 | 3/1967 | Crownover | 239/550 X |
| 3,339,847 | 9/1967 | Schlumberger | 239/550 X |
| 3,378,202 | 4/1968 | McKenzie . | |
| 3,378,302 | 4/1968 | McKenzie . | |
| 3,817,454 | 6/1974 | Pira | 239/76 |
| 3,845,635 | 11/1974 | Perkins et al. | 239/550 X |
| 3,917,166 | 11/1975 | Hildebrandt et al. | 239/1 |
| 3,917,174 | 11/1975 | Hildebrandt et al. | 239/542 |
| 4,176,791 | 12/1979 | Cattaneo et al. | 239/76 |
| 4,374,658 | 2/1983 | Kawaguchi | 62/35.10 |
| 4,454,723 | 6/1984 | Weasel | 62/373 X |

FOREIGN PATENT DOCUMENTS

| | | | |
|---|---|---|---|
| 261023 | 5/1970 | U.S.S.R. | 239/548 |

*Primary Examiner*—Andres Kashnikow
*Assistant Examiner*—Kevin P. Weldon
*Attorney, Agent, or Firm*—George F. Bethel; Patience K. Bethel

[57] ABSTRACT

A method and apparatus for balancing the discharge of liquified gases from a multi-orifice manifold. The manifold includes at least one main conduit each having a central axis, and two or more discharge conduits each having a central axis. Each discharge conduit projects from the main conduit in a manner whereby the central axis of each discharge conduit extends from the central axis of the main conduit. The discharge conduits are positioned about the central axis of the main conduit such that each central axis of a discharge conduit provides with respect to a substantially horizontal plane passing through the central axis of the main conduit, an included angle in the range of about −30° to about −60° relative to the horizontal plane. A discharge orifice is attached to each discharge conduit and is oriented to provide downward discharge.

2 Claims, 3 Drawing Sheets

FIG. 2
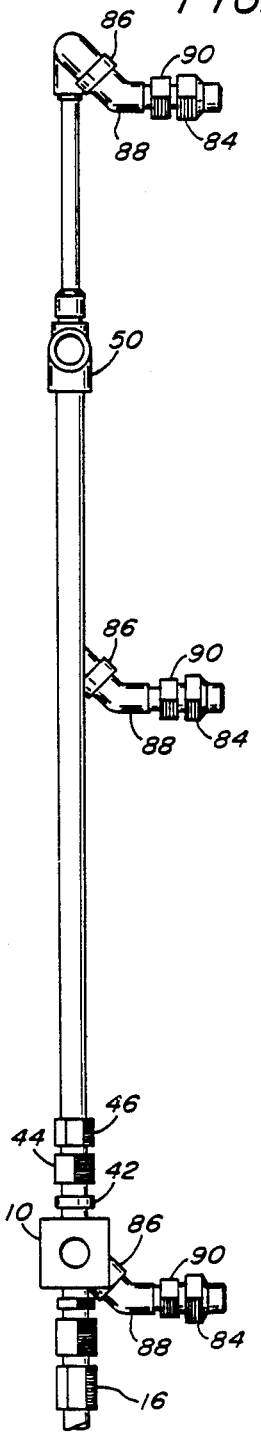
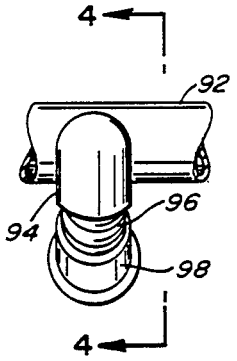
FIG. 3
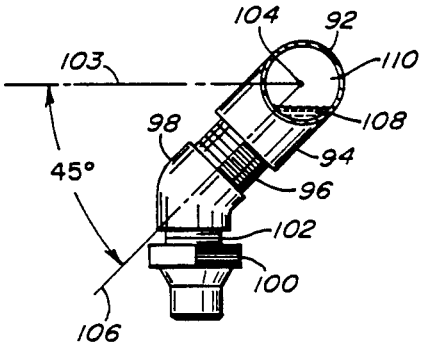
FIG. 4
A12

MULTI-ORIFICE MANIFOLD FOR BALANCING DISCHARGE OF LIQUIFIED GASES

BACKGROUND OF THE INVENTION

1. Field of the Invention

This invention relates to the field of liquified gases such as carbon dioxide and nitrogen and particularly to an apparatus and method for balancing the discharge of such liquified gases through a multi-orifice manifold.

2. Description of the Prior Art

Liquified gases such as liquified nitrogen and liquified carbon dioxide are used extensively for the rapid chilling of various products, especially food products. Normally, food or other products to be chilled are moved by means of a conveyor belt through a freezing tunnel or enclosure containing an overhead arrangement of spray nozzles. The liquified gas is sprayed onto the products to be frozen as they pass through the freezing tunnel.

Liquified gases are stored under high pressures in order to maintain their liquified condition. Upon introduction into a manifold containing multiple discharge orifices, a considerable pressure reduction takes place. This results in a mixture of vapor and liquid. When the rate of flow within the manifold is not turbulent, the liquid and vapor separate with the liquid on the bottom and the vapor on the top. In this instance, the discharge orifice which is closest to the source of supply discharges liquid, and the discharge orifice farthest away from the supply discharges vapor. The intervening discharge orifices contain a mixture of liquid and vapor.

This condition is highly unsatisfactory, since it is desired to have equal amounts of liquid discharged from each of the discharge orifices of the manifold in order to provide rapid and balanced chilling of the product.

The above condition could be alleviated at least in part by sizing the discharge pipe for turbulent flow, or including pipe mixers or individual orifice mixers. However, these methods are not applicable to different orifice sizes, different orifice configurations, or differences in specific pressures. In addition, the extremely cold temperatures of the liquified gases can produce special problems. For example, such devices and methods could be unworkable due to the possibility of the production of ice in the case of liquid carbon dioxide which could freeze solid and plug the lines entirely.

As a consequence of the above problems, it is desirable to be able to control or balance the mass flow rate per orifice during the reduction of pressure. Ideally, such a solution should be relatively simple to avoid any problems with snow or ice buildup.

SUMMARY OF THE INVENTION

The present invention provides such a solution. The manifold and discharge conduits were sized for laminar flow. The discharge conduits were then made perpendicular to the main conduit. Discharge of liquified gases was then made in positions whereby the discharge headers varied from straight down to straight up.

It was found that in the straight down position, the orifice closest to the supply line discharged liquid, and the orifice furthest from the supply line discharged vapor. This was consistent with prior art devices.

By contrast, when the discharge conduits were in the straight up position, the orifice closest to the supply line discharged vapor, and the orifice farthest from the supply line discharged liquid.

When the discharge orifices were rotated to a point approximately halfway between straight down and a horizontal position to produce an included angle of about 45° as measured from the straight down position, it was found that discharges from a six orifice manifold with throttled pressure ranging from 300 psig to 185 psig produced a balanced, fairly uniform discharge of liquid and vapor from each orifice.

The addition of a 45° elbow to which the discharge orifices were attached in order to provide straight down discharge, provided the same good results. It was also found that varying the size of the orifice did not alter the results.

Other objects and advantages of the invention will be obvious from the followng description taken with reference to the accompanying drawings which form a part of the invention.

BRIEF DESCRIPTION OF THE DRAWINGS

FIG. 2 shows a side view of the manifold of FIG. 1;

FIG. 3 shows a slightly enlarged side view of a single discharge orifice according to the invention;

FIG. 4 shows the discharge orifice of FIG. 3 as viewed in the direction 4—4 of FIG. 3, and, FIG. 5 shows a schematic view of a preferred arrangement of discharge orifices in a manifold according to the invention.

DETAILED DESCRIPTION OF THE INVENTION

Figure 1:
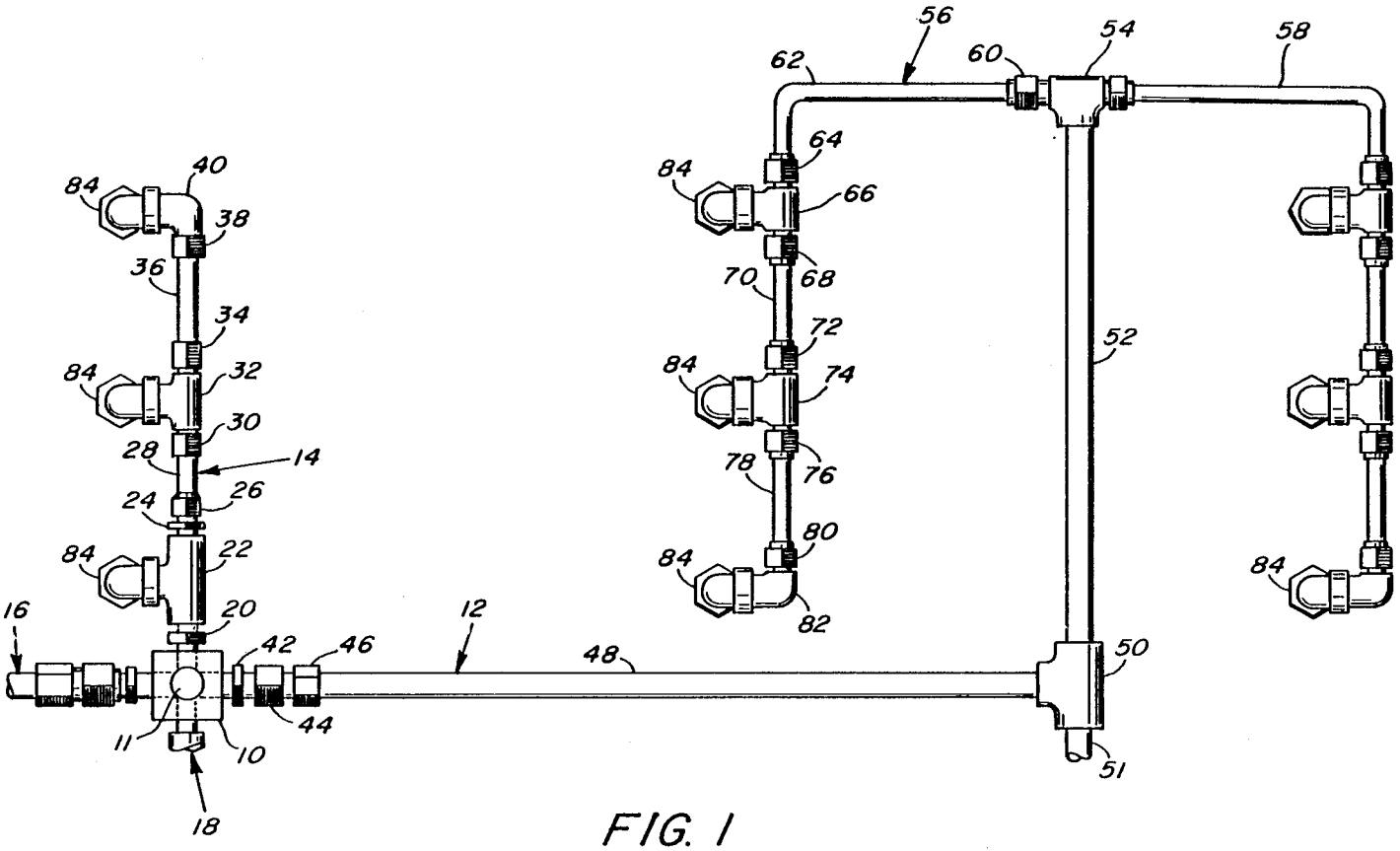
FIG. 1 shows a plan view of a portion of a multi-orifice manifold according to the invention which is shown schematically in FIG. 5.

Referring now to FIG. 1, there is shown a broken away portion of a manifold according to the invention. As shown, a square stock supply connector 10 is provided with four interiorly threaded openings which intersect perpendicularly in a central supply channel 11. The threaded openings are connected to four branches 12, 14, 16 and 18.

Branch 12 is bilaterally symmetrical with branch 16; and branch 14 is bilaterally symmetrical with branch 18. For convenience, only a portion of the manifold is shown. In it completed configuration, shown schematically in FIG. 5, there are five parallel rows each having six injectors per row.

Beginning with branch 14, supply connector 10 is connected to hex nipple 20 which is connected to branch Tee 22. Branch Tee 22 is connected in turn to hex nipple 24, which is connected to connector 26, which is connected to tube 28 followed by connector 30. Connector 30 is attached to branch Tee 32, then to connector 34 which is in turn connected to pipe 36. The end of pipe 35 is connected to connector 38 which is connected in turn to right angle elbow 40.

Branch 12 extends from supply connector 10 through connector 42 which is connected to connector 44. Connector 44 is connected to connector 46 and then to tube 48. The end of tube 48 is connected to branch Tee 50.

Figure 5:
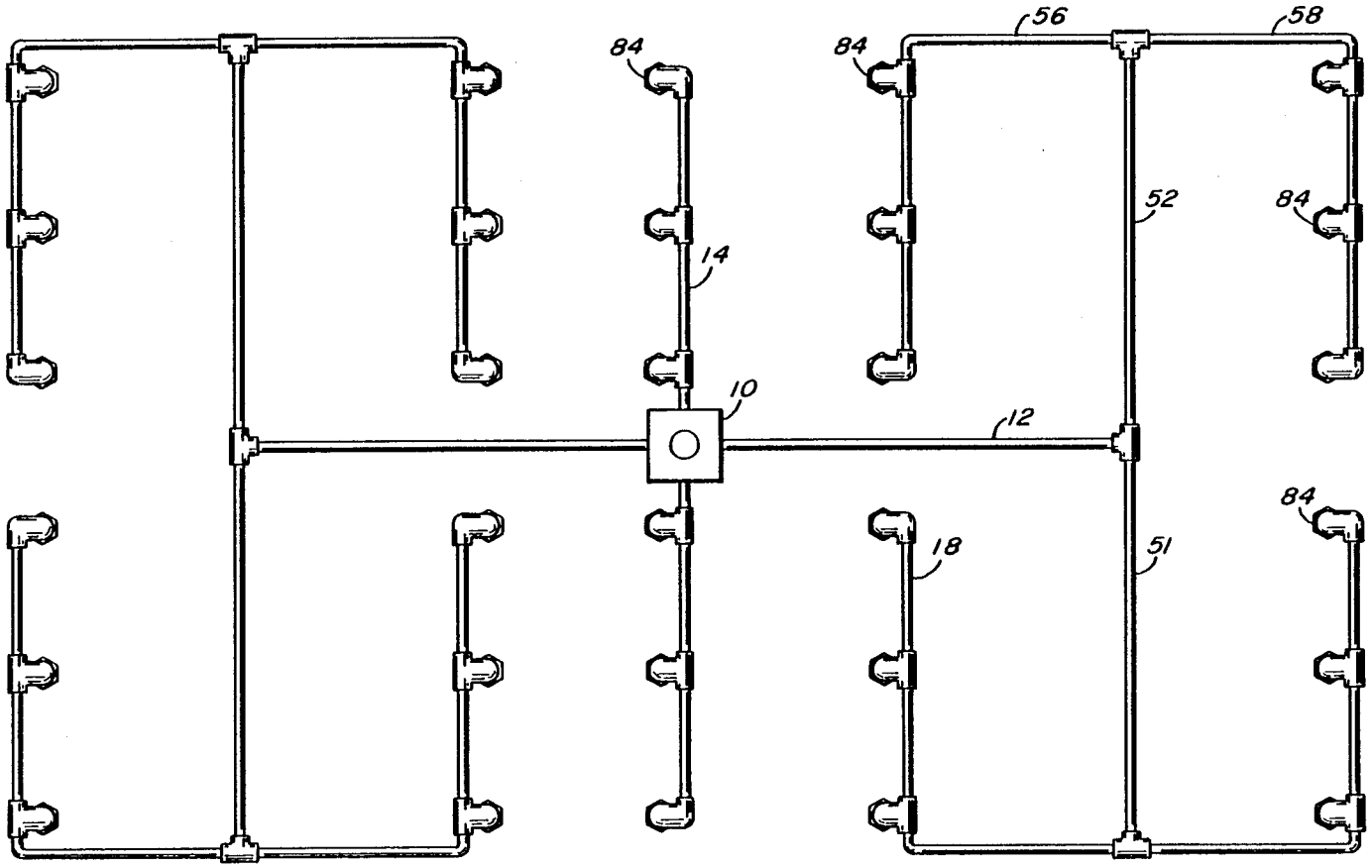

As can be seen in FIG. 5, branch Tee 50 connects two bilaterally symmetrical branches through tubes 51 and 52. Only the branch extending from tube 52 is shown in detail.

Tube 52 is connected at one end to branch Tee 50 and at its other end to branch Tee 54 where it bifurcates into two bilaterally symmetrical branches. These branches are indicated at 56 and 58.

Since the branches are identical it is only necessary to describe one of them. Attached to branch Tee 54 is connector 60 which is connected in turn to pipe 62, then to connector 64 which in turn is connected to branch Tee 66. The opposite end of branch Tee 66 is connected to connector 68, to pipe 70. Pipe 70 is joined to connector 72 which is connected to branch Tee 74, then to connector 76, to pipe 78, then to connector 80, and terminates in right angle elbow 82.

Each of the branch Tees 22, 32, 66 and 74, as well as right elbows 40 and 82 is connected to a connector 86 which in turn is connected to a 45° elbow 88 which is connected in turn to a connector 90 which is connected to a nozzle 84.

This can be seen in greater detail in FIG. 2.

The manifold illustrated in FIGS. 1 and 2 are intended only to be illustrative of a preferred embodiment of the invention. The manifold is preferably composed of materials such as stainless steel and brass which are resistant to corrosion and which also will withstand high pressures and low temperatures. This necessitates the large number of connectors. However, it should be understood that each branch containing two or more nozzles could be cast as a single unit which could then be attached to the central supply line 10 using fewer connectors.

FIGS. 3 and 4 illustrate two views of another nozzle according to the invention. FIG. 3 shows a side view including a supply tube 92 having an attached nipple 94 which is attached in turn to a short section of pipe 96. The other end of the short section of pipe 96 is connected to a 45° elbow 98. This is connected to a nozzle 100 through another short section of pipe 102.

As shown in FIG. 4, a horizontal line 103 drawn perpendicular to the central axis 104 of the supply line 92 forms a 45° angle with another line drawn through the central axis of tube 96 and nipple 94 and perpendicular to the central axis 104 of the supply tube 92 where it intersects line 103. The 45° elbow 98 orients the nozzle 100 for straight down discharge.

In FIG. 4 the liquid 108 and vapor 110 are shown schematically. It can be seen that the edge of the liquid 108 is intersected by the central axis 106 passing through tube 98 and nipple 94. While this is only a schematic representation, approximately half of the volume of the nipple 94 through which the liquid 108 and vapor 110 are discharged is occupied by the liquid 108 and the remaining half is occupied by the vapor 110. The result is that there is an even discharge of vapor and liquid throughout each of the nozzles 100. This is true for a manifold containing two or more discharge conduits with attached nozzles as shown in FIGS. 1. 2 and 5.

The −45° angle of configuration of the nozzle of FIG. 4 relative to an initial horizontal position constitutes the most preferred embodiment of the invention. This provides substantially balanced discharge of liquid and vapor from the discharge conduits. The practical range of the invention, however, extends from about −30° to about −60° downward rotation of the central axis of the discharge conduits relative to an initial horizontal position. At about −30° there will be proportionately more vapor than liquid in the discharge conduits closest to the supply line and proportionately more liquid than vapor in the discharge conduits farthest from the supply line. At the other end of the range, −60° from the horizontal there will be proportionally more liquid than vapor in the discharge conduits closest to the supply line and proportionately more vapor than liquid in the discharge conduits farthest from the supply line.

As mentioned above, it is important to size the pipe for laminar flow to avoid creating turbulence and to avoid pressure drops. Preferably, the diameter of all of the tubes leading from the supply connector 10 are the same. In addition, it is preferred that the discharge conduits also have the same diameter. For example, in FIG. 4, the diameter of supply conduit 92 would be the same diameter as that of nipple 94 and tube 96 as well as elbow 98 and tube 102. Such consistency of tube diameter avoids pressure drops and provides consistent predictable results.

In the embodiment shown in FIGS. 1 and 2 the central supply opening 11 has an interior diameter of ¾ of an inch. Pipes 48, 52, 58 and 62, as well as short sections 36, 28, 70 and 78 have an interior diameter of ¼ inch. An interior diameter of ¼ inch is also maintained within the branch Tees and elbows used throughout the manifold system. Excellent results have been obtained using the above mentioned ¼ inch diameter tubing and connections.

Using throttled pressure from 300 psig to 185 psig has produced a balanced discharge from each of the orifices forming a part of the manifold of FIGS. 1 and 2 over an orifice size range from 0.02 inch to 0.04 inch.

Also, it has been found that best results have been obtained when the piping is sized such that the cross sectional area of each of the main tubes and the discharge tubes is greater than five times the cross sectional area of the discharge orifices.

The invention thus described provides a method and apparatus for balancing the discharge of liquified gases from a multiorifice manifold.

Various modifications of the invention are contemplated which will be obvious to those skilled in the art. Such modifications can be resorted to without departing from the spirit and scope of the invention as defined by the following appended claims.

I claim:

1. A manifold for discharge of liquified gas comprising:

at least one main conduit, each conduit having a substantially central axis:

two or more openings within said main conduit;

two or more discharge conduits each having a substantially central axis;

each of said discharge conduits extending exteriorly from one of said openings within said main conduit;

said discharge conduits having substantially the same diameter as the diameter of said main conduit; and, said discharge conduits being positioned exteriorly about said central axis of said main conduit such that each central axis of a discharge conduit provides with respect to a substantially horizontal plane passing through said central axis of said main conduit, an included angle in the range of about −30° to about −60° relative to said horizontal plane.

2. A method for balancing the discharge of liquified gas from two or more discharge conduits connected to a supply conduit comprising:

providing at least one main supply conduit, each conduit having a substantially central axis and having two or more openings therein;

providing at least two discharge conduits each having a substantially central axis and being attached to a main supply conduit so that each discharge conduit extends exteriorly from one of said openings within said main conduit;

sizing said discharge conduits to have substantially the same diameter as said main conduit; and, rotating said discharge conduits downwardly about −30° to about −60° from the horizontal position.

* * * * *